United States Patent [19]

Brown et al.

[11] 3,993,392

[45] Nov. 23, 1976

[54] CONNECTOR

[75] Inventors: Otice E. Brown; Richard D. White, both of El Paso, Tex.

[73] Assignee: Globe Universal Sciences, Inc., Houston, Tex.

[22] Filed: Nov. 6, 1975

[21] Appl. No.: 629,449

[52] U.S. Cl. ..... 339/98

[51] Int. Cl.[2] ..... H01R 9/08

[58] Field of Search ..... 339/97–99, 339/147, 273, 274

[56] References Cited

FOREIGN PATENTS OR APPLICATIONS

| | | | |
|---|---|---|---|
| 934,503 | 5/1948 | France | 339/97 P |
| 1,615,753 | 5/1970 | Germany | 339/273 F |
| 390,294 | 4/1933 | United Kingdom | 339/98 |
| 661,480 | 11/1951 | United Kingdom | 339/99 R |
| 699,856 | 11/1953 | United Kingdom | 339/99 R |

*Primary Examiner*—Joseph H. McGlynn
*Attorney, Agent, or Firm*—Arnold, White & Durkee

[57] ABSTRACT

This invention is a connector for making electrical connections between separate sections of cable in a line, a section of cable and a tap line, or leads of a cable to be terminally joined. The connector, which minimizes transmission noise and cross talk problems in these connections, comprises a nonconductive base slotted to accommodate the cable, sharp electrical contact pins or prongs in the base, extending up into the slot, and a nonconductive member which slides through an opening in the base, transverse to and through the slot, thereby forcing a previously inserted cable against the contact pins or prongs to make electrical contact.

3 Claims, 8 Drawing Figures

FIG. 1
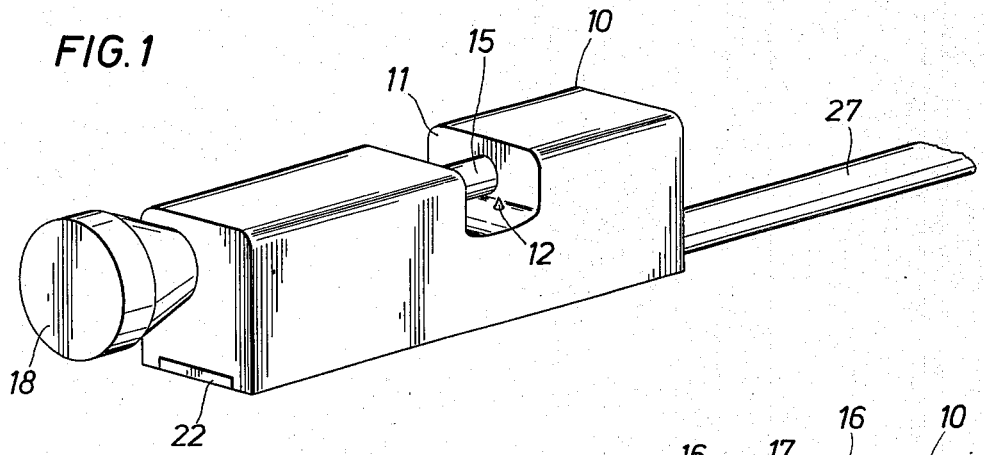
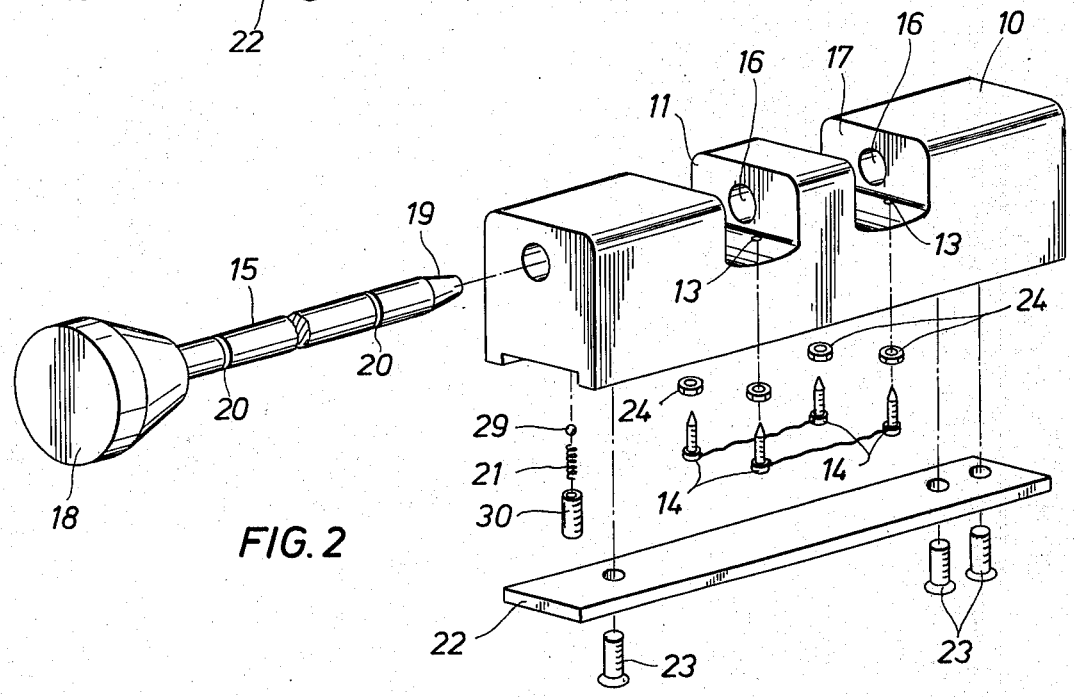
FIG. 2
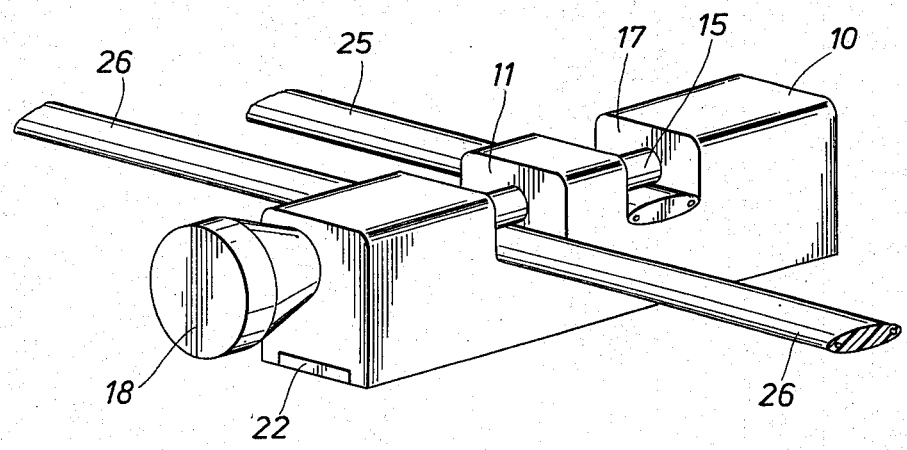
FIG. 3

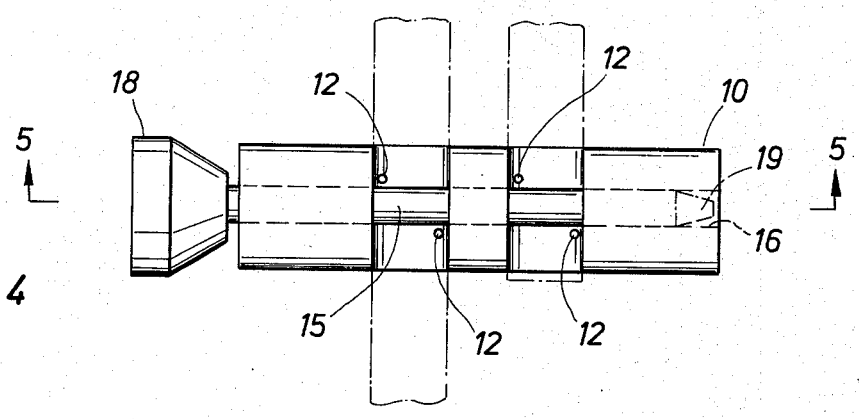
FIG. 4
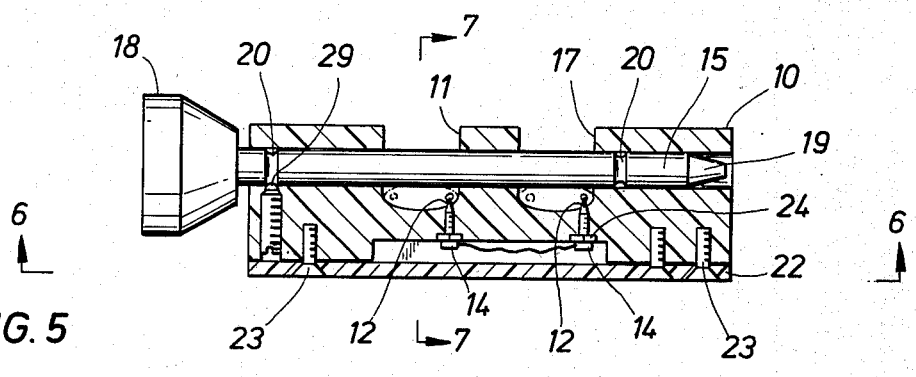
FIG. 5
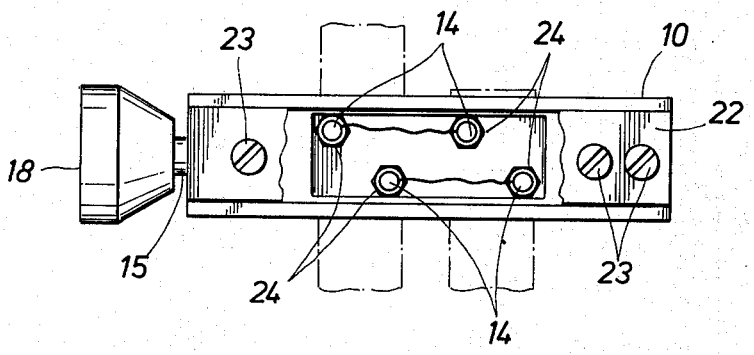
FIG. 6
FIG. 7
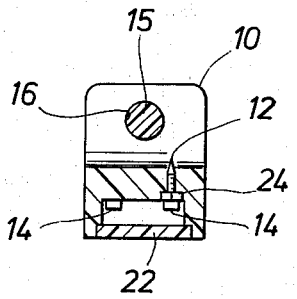
FIG. 8
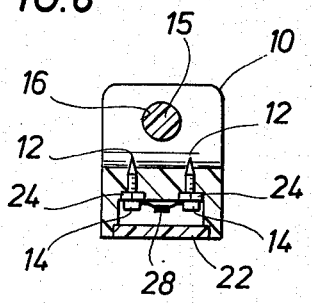

CONNECTOR

BACKGROUND OF THE INVENTION

This invention relates to electrical connectors, and particularly to connectors adapted for making temporary connections to cables having an outer insulator and an inner conductor.

Various connectors have long been available for making solderless connections between insulated wires. They generally include three main parts: a base, one or more contacts, and a cover. The base is typically an insulating piece having tunnels, channels, or slots into which the wires to be interconnected are inserted. The cover, also an insulator, may be arranged to substantially enclose the base, or may simply hold the wires fast against the contacts, without functioning as a total cover. Each contact is typically a grooved metal knife-like plate supported by either the base or the cover, transverse to the cable. Closing the cover forces the contact's sharp edge against the cable, and in so doing, cuts through the insulation to make electrical contact with the conductor. This knife action contact has the disadvantages of requiring substantial force to make the requisite electrical connection, and resulting in excessive damage to the insulation. Excessive damage results in additional exposure of the wire conductor, thus giving rise to oxidation of the conductive metal if the connector is removed. Primarily for that reason, most of the prior art connectors involving knife-like contacts are for permanent solderless connections, rather than connection intended as temporary on a cable intended to be repeatedly used and reconnected. The damage that results to the insulation is not of material significance in the case of permanent connections since the wires are typically not re-exposed for different use.

For making temporary electrical connections, a connector should be capable of being used without undue difficulty, should provide a quick and reliable electrical connection, and should not result in undue damage to the insulation on the cable. Connectors of this type also have the insulating base and cover, and one or more contact pieces, but the cover for a temporary connector need only provide the pressing action against the base to force the cable into the slots to make contact. It need not completely cover that portion of the base into which the cable is inserted. It is important, however, that a temporary connector does not leave the insulation of the cable so cut and damaged that a substantial portion of the wire conductor is left exposed to dirt, oxidation, and potential grounding. Accordingly, a connector for making temporary solderless connections should not result in excessive damage to insulation of the cables connected.

For certain applications in the field, e.g., transmitting seismic data from shot stations (monitor sites located near seismic shots or disturbances set off typically in conjunction with mineral or geological exploration), it is important that the data transmission cables be easily, quickly, and reliably interconnected, time after time. Since connections must sometimes be made linking the cables together end to end (in-line splice), and other times tapping one cable into the middle of a section of another (tap-line splice), the in-the-field connector should be versatile and multi-functional.

It is apparent that there exists a need for a temporary connector that can be used and reused in the field, and that will provide a quick, strong, and reliable electrical connection that will not result in excessive damage to the cable's insulation. The subject invention provides such a connector.

It is therefore a feature of this invention to provide a temporary electrical connector that may be easily and quickly used to attain a reliable and durable connection which, when disconnected, leaves the cable in usable condition. An underlying feature of the invention is the minimizing of expposed conducting wire and consequently the oxidation thereof. The invention may be interchangeably used and reused, for both in-line and tap-line connections, and provides mechanical support to the cables leading from the connector, to help prevent mechanical failure, and hence electrical failure, due to tensional or torsional stresses applied to the cables.

SUMMARY OF THE INVENTION

This invention provides a connector for making various types of electrical connections to insulated cable, without any need for stripping or otherwise preparing the cable. The invention is helpful in minimizing transmission noise and cross talk problems in these various connections, because all nonconductively functioning components of the connector are of insulating material.

Preferably in accordance with the subject invention, the connector base is of an insulating material and has one or more slots in which each cable to be connected is laid or inserted. Each slot is of predetermined width and depth, to accommodate cables of certain size, and to allow for proper piercing of the insulation of the cable by conical, pointed, sharp contact pins or prongs. The prongs are mounted in the base, and extend into the open portion of each slot. In operation, the cable, after being inserted, is forced against the prongs by the wedge-action insulating rod which moves through holes in the base. The holes are transverse to and through each slot, and the movable rod is partially tapered (to provide the wedge-action) on one end, to urge the cable further into the slot as the rod is pushed through the base. The holes, and hence the rod passing therein, are located so that the contact pins will pierce the insulation and make conductive contact with the conductor. The rod is moved from its inoperative mode (open) to its operative mode (closed), wherein it holds the cable securely in the slot against the contact pins. Further, the connector base preferably has a cover plate fastened to the base by screws, both the cover plate and the screws being of suitable insulating materials to minimize noise and cross talk.

One embodiment of the invention, the connector base having two slots, may be used for making in-line connections or tap-line connections. For in-line connections, each slot may be used to accommodate an end of each cable section to be connected in line. For tap-line connections, one slot may be used to accommodate the cable to be tapped into another cable, while the second slot is used to accommodate the tapped cable. The contact pins in the first slot are parallelly and premanently connected to the pins of the second slot.

In another embodiment having only one slot, the tap-line may be permanently attached to the connector, such that only the one slot is required to accommodate the tapped into cable. Likewise, the single slot connector may be used to connect a section of cable to equipment, the connector being directly attached to or mounted on the equipment. The contact pins are permanently connected to leads of the permanently attached cable, or those connecting the equipment. Also the connector embodiment having only one slot may be used to connect the conductors of a cable; the connector base in such an embodiment has a conductor of a predetermined impedance appropriate for the circumstances connected between the pins in the slot.

BRIEF DESCRIPTION OF THE DRAWINGS

FIG. 1 is a perspective view of an assembled connector having a single slot, suitable for cable connections to a permanent tap line, or to equipment, or to a terminating impedance in the connector base.

FIG. 2 is an exploded perspective view of a connector having two slots, suitable for in-line or tap-line connections.

FIG. 3 is a perspective view of the connector shown in FIG. 2, showing a cable tapped into a through going cable.

FIG. 4 is a top view of the connector shown in FIG. 2.

FIG. 5 is a front sectional view of the connector shown in FIG. 2.

FIG. 6 is a bottom view of the connector shown in FIG. 2.

FIG. 7 is a side sectional view of the connector shown in FIG. 2.

FIG. 8 is a side sectional view of the connector embodiment having a terminating resistor.

DETAILED DESCRIPTION OF THE INVENTION

The subject invention comprises a multipurpose connector suitable for making various electrical connections between insulated cables, without need for stripping or otherwise preparing the cables.

FIG. 1 shows an embodiment of the subject invention suitable for connecting a single section of cable to whatever the contact pins or prongs (only one shown in the pictorial view of FIG. 1) are in turn attached, a cable 27 in this instance. The base 10 is of a durable insulating material, for example, polycarbonate. The base has a slot 11 to accommodate a cable. Contact pins 12 are supported in the base 10, and extend through the lower portion of the slot 11 into the space in which a cable is inserted for connection. The conical, sharp, prong-like contact pins 12 pierce the insulation of a cable forced against them by the partially tapered rod 15, shown in the closed position in FIG. 1, without a cable in the slot 11. The contact pins 12 are preferably of case hardened steel, to provide a very hard point for piercing the insulation of the cable, and in turn making electrical contact with a conductor of a cable. The contact pins 12 have threaded portions by which they are secured in the base 10 by nuts 24 mounted therein, preferably by epoxy. FIG. 2 shows the holes 13 for the contact pins 12.

The contact pins 12 are inserted through the bottom of the base 10. The bottom portion of the base 10 is then covered with a cover plate 22, which is fastened to the base by insulating screws 23, shown in FIGS. 2 and 6. The importance of using insulating materials for the cover plate as well as for the base is due to the necessity for eliminating cross talk between the conductors of the cable, because such cross talk changes the impedance of the cable. Inside the cover are the conductor attachment 14 secured to each contact pin 12, and in the case of a terminating connector, shown in FIG. 8, the terminating impedance 28, connecting the contact pins 12 by means of the conductor attachments 14.

FIG. 3 shows the partially tapered rod 15 in the closed position, after it has forced previously inserted cables 25 and 26 further into slots 17 and 11 respectively, to make electrical contact with the contact pins 12. The partially tapered rod 15 slides through holes 16 in the base 10 (FIG. 2). The holes 16 are transverse to and extend through the slot 11 in FIG. 1, and through both the slot 11 and second slot 17 in the embodiment of FIGS. 2–6. The rod 15 is preferably of fiberglass material about one-quarter inch in diameter. The rod 15 is conveniently opened and closed by hand, and thus is provided with a knob 18, of laminated phenolic about one inch in diameter. The rod 15 functions by means of a tapered portion 19 forcing a previously inserted cable against the pins 12 as the rod 15 is pushed through the holes 16 in the base 10.

In order to retain the rod 15 in its open and closed positions, indentations 20 are provided near the tapered portion of the rod, and also near the knob 18 of the rod. A spring 21 is mounted inside the base 10, and tranverse to and communicating with the hole 16 through which the rod 15 passes. The spring 21 is secured in the base by a setscrew 30 and retains the rod 15 by extending a detent 29 when the identations 20 are in line with the spring 21.

The embodiment of the subject invention shown in FIGS. 2 and 3 may be used to connect ends of cables (in-line splice) or to connect the end of a section of cable to the middle of a section of cable (tap-line splice). FIG. 3 illustrates a tap-line splice, cable 25 tapping into the continuous section of cable 26. A tap-line splice could also be effected with the embodiment shown in FIG. 1 if the connector were already connected to a cable 27 adapted, for example, for connection to equipment or to any other cable.

The exploded connector shown in FIG. 2 is the variety useful for both in-line and tap-line connections. The connector could likewise have three slots, suitable for making parallel connections between three different continuing sections of cable, or for tapping the ends of two sections of cable into one continuing cable.

Since the contacts are sharp, pointed pins, they pierce the insulation of the cable only in a small area, and do not result in substantial damage as in the case of knife-like contacts which tend to make a substantial cut into the insulation, and even into the stranded cable in some cases. For use with conventional twin-lead wire, such as that used for connecting television antennae to television receivers, and frequently for data transmission lines in field operations, the pins are located in the base at a specified width, extending a specified elevation above the lower portion of the slot. This is important so that the pins will pierce the optimum amount of cable in order to make a good electrical connection, but without excessively damaging the insulation and conductor. It is also important for the purpose of minimizing the amount of force required to push the rod through the base to force the previously inserted cable against the pins. Varying sizes and types of cable can be used for appropriately sized connectors of this type as long as the cables have substantially parallel running, not twisted, twin leads.

The invention enables a person working in the field with, for example, seismic measuring and recording equipment, to make rapid, reliable, and durable connections between different sections of cable. The connections may then be broken, the cable moved, and new connections made, repeatedly reusing the same connectors and the same pieces of cable, without even trimming the end portions of the cables which were previously inserted into and pierced by the connector. The strength and durability of the connector and resulting connection is important because of the constant dragging forces exerted on the cables and the connections. The connection made by the subject invention is sufficiently strong that, when the cables are sometimes inadvertently dragged or moved, thus resulting in substantial tensional forces being placed on the connections, the connectors are not damaged; nor are the connections; nor is the cable permanently damaged in excess of that resulting from the small contact pins piercing the insulation of the cable.

The strong connection results from the wedge-like action of the tapered portion 19 of the rod 15 closing down on a cable previously inserted into the slot 11 of the connector. Use of such a clamping or closing device, rather than the typical cover of most solderless connectors, allows for rapid connections that are not excessively damaging to the connector, and that may therefore be repeatedly done. The rod is easily closed for operation, and likewise easily opened to disconnect the cables. Risk of inadvertent opening or loss of the rod is eliminated by the spring retainer. No bulky cover is involved, and little care need be exercised in making connections.

In view of the preceding description of a particular preferred embodiment, and other embodiments as well, further modifications and alternative embodiments of this invention will be apparent to those skilled in the art. Accordingly, the preceding description is to be construed as explanatory and illustrative only and is for the purpose of teaching and enabling those skilled in the art to make and use the invention. The preferred embodiments of the invention shown and described herein are to be understood to be the best modes presently contemplated, but are by no means the only embodiment possible. Various changes may be made in the mere shape, size, or arrangement of parts. Equivalent elements or materials may be substituted for those illustrated and described herein, parts may be reversed, and certain features of the invention may be utilized independently of the use of other features. For example, the concept of the partially tapered closing rod in lieu of a cover may be employed to connect the ends of many cables at one junction. Or, the connector of the subject invention may be integrally manufactured with commercially available connectors, such that the cables could be connected to a connector attached to other connectors or equipment. The following claims are intended to cover all such equivalent modifications and variations that fall within the true spirit and scope of the invention.

What is claimed is:

1. A connector for making in-line, tap or terminal connections to insulated twin lead cable, and for minimizing transmission noise and cross talk problems in said connections, comprising:

a nonconductive base having at least one slot of predetermined width and depth to accommodate the cable;

conductive contact pins in said base, said pins extending into said slot and being of a predetermined length and at a predetermined distance apart, for piercing the insulation of the cable to make conductive contact;

a nonconductive rod, movable through an opening in said base, transverse to and communicating with said slot, said rod being movable from an inoperative position allowing insertion of a cable, to an operative position after insertion of a cable, said rod in its operative position being at a distance from said pins to urge the cable against said pins to pierce the insulation and to make conductive contact; and retaining means for holding said rod in said base in either its operative or inoperative position.

2. A connector for making in-line connections between sections of insulated twin lead cable, and for minimizing transmission noise and cross talk problems in said connections, comprising:

a nonconductive base having first and second slots of predetermined width and depth, each slot to accommodate a separate section of cable to be connected;

first conductive contact pins said base, said pins extending into said first slot and being of a predetermined length and at a predetermined distance apart, for piercing the insulation of the cable to make conductive contact;

second conductive contact pins in said base, said pins extending into said second slot and being of a predetermined length and at a predetermined distance apart, for piercing the insulation of the cable to make conductive contact, each conductively connected to one of said first contact pins;

a nonconductive rod movable through an opening in said base, transverse to and communicating with said first and second slots, said rod being movable from an inoperative position allowing insertion of cables, to an operative position after insertion of cables, said rod in its operativee position being at a distance from said pins to urge the cables against said first and second pins and to pierce the insulation and to make conductive contact; and retaining means for holding said rod in said base in either its operative or inoperative position.

3. A connector for making tap line connections to insulated twin lead cable, and for minimizing transmission noise and cross talk problems in such connections, comprising:

a nonconductive base having a slot of a predetermined width and depth, to accommodate the cable;

conductive contact pins in said base, said pins extending into said slot and being of a predetermined length and at a predetermined distance apart, for piercing the insulation of the cable to make conductive contact, and conductively connected to a tapline;

a nonconductive rod movable through an opening in said base, transverse to and communicating with said slot, said rod being movable from an inoperative position allowing insertion of a cable, to an operative position after insertion of a cable, said rod in its operative position being at a distance from said pins to urge the cable against said pins, thereby piercing the insulation and making conductive contact; and retaining means for holding said rod in said base in either its operative or inoperative position.

* * * * *